US007431801B2

(12) United States Patent
Conn et al.

(10) Patent No.: US 7,431,801 B2
(45) Date of Patent: Oct. 7, 2008

(54) CREPING BLADE

(75) Inventors: Richard Harvey Conn, Green Bay, WI (US); Kerry Paul Robb, Colerain Township, OH (US); Robert Charles Dreisig, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 681 days.

(21) Appl. No.: 11/044,849

(22) Filed: Jan. 27, 2005

(65) Prior Publication Data

US 2006/0162881 A1 Jul. 27, 2006

(51) Int. Cl.
*D21G 3/00* (2006.01)

(52) U.S. Cl. ..... 162/281; 15/256.51; 118/413

(58) Field of Classification Search ..... 162/280–281; 118/413; 15/256.51
See application file for complete search history.

(56) References Cited

U.S. PATENT DOCUMENTS

| | | | | | |
|---|---|---|---|---|---|
| 2,972,767 | A | * | 2/1961 | Smith | 15/256.51 |
| 3,703,019 | A | * | 11/1972 | Bratt | 15/256.51 |
| 3,973,845 | A | * | 8/1976 | Lindblad et al. | 399/350 |
| RE29,417 | E | * | 9/1977 | Lee et al. | 162/274 |
| 4,185,399 | A | * | 1/1980 | Gladish | 34/120 |
| 4,549,933 | A | | 10/1985 | Judd et al. | |
| 4,600,599 | A | | 7/1986 | Wallsten | |
| 4,789,432 | A | | 12/1988 | Goodnow et al. | |
| 4,906,335 | A | | 3/1990 | Goodnow et al. | |
| 4,919,756 | A | | 4/1990 | Sawdai | |
| 5,032,229 | A | | 7/1991 | Boucher | |
| 5,035,196 | A | | 7/1991 | Mannio | |
| 5,110,415 | A | | 5/1992 | Boucher et al. | |
| 5,356,519 | A | | 10/1994 | Grabscheid et al. | |
| 5,403,446 | A | | 4/1995 | Trelsmo et al. | |
| 5,489,364 | A | | 2/1996 | Marinack | |
| 5,507,917 | A | | 4/1996 | Didier et al. | |
| 5,512,139 | A | | 4/1996 | Worcester | |
| 5,674,361 | A | | 10/1997 | Marinack | |
| 5,728,434 | A | | 3/1998 | Hewitt | |
| 5,783,042 | A | | 7/1998 | Leeman et al. | |
| 5,849,158 | A | | 12/1998 | Costello et al. | |
| 5,863,329 | A | | 1/1999 | Yamanouchi | |
| 5,944,958 | A | | 8/1999 | Svanqvist | |
| 6,027,614 | A | | 2/2000 | Parker et al. | |

(Continued)

FOREIGN PATENT DOCUMENTS

DE 20 30 882 A1 12/1970

(Continued)

OTHER PUBLICATIONS

Brochure entitled "Creping Doctor Blades", Uddeholm Strip (Jul. 2003).

*Primary Examiner*—José A Fortuna
(74) *Attorney, Agent, or Firm*—Peter T. Nguyen; Peter D. Meyer; David M. Weirich

(57) ABSTRACT

A creping blade including a body having a leading side, a trailing side, and working end including a bevel surface. The bevel surface is defined by a leading edge and a trailing edge, wherein the trailing edge of the creping blade has a trailing edge radius of greater than about 0.001 inches (about 0.0254 mm).

15 Claims, 8 Drawing Sheets

U.S. PATENT DOCUMENTS

| | | | | |
|---|---|---|---|---|
| 6,027,765 | A | 2/2000 | Kaneko | |
| 6,042,693 | A | 3/2000 | Marinack | |
| 6,066,234 | A | 5/2000 | Parker et al. | |
| 6,074,526 | A | 6/2000 | Marinack | |
| 6,113,470 | A | 9/2000 | Marinack | |
| 6,139,638 | A | 10/2000 | Dubois et al. | |
| 6,207,021 | B1 | 3/2001 | Eriksson et al. | |
| 6,328,853 | B1 | 12/2001 | Goodnow et al. | |
| 6,416,843 | B1 | 7/2002 | Rata et al. | |
| 6,419,748 | B1 | 7/2002 | Kaneko | |
| 6,423,427 | B1 | 7/2002 | Mehmood | |
| 6,527,913 | B1 | 3/2003 | Johnson et al. | |
| 6,558,510 | B1 * | 5/2003 | Edwards et al. | 162/111 |
| 6,565,712 | B2 | 5/2003 | Lindenfelser | |
| 6,565,991 | B1 | 5/2003 | Mehmood | |
| 6,643,890 | B2 | 11/2003 | Carrier | |
| 6,682,012 | B1 | 1/2004 | Parviainen et al. | |
| 6,687,950 | B1 | 2/2004 | Rata et al. | |
| 6,830,659 | B2 | 12/2004 | Sovijarvi | |
| 6,837,930 | B2 | 1/2005 | Kaneko | |
| 2002/0174966 | A1 | 11/2002 | Brauns et al. | |
| 2002/0176934 | A1 | 11/2002 | Rata et al. | |
| 2002/0189777 | A1 | 12/2002 | Rata et al. | |
| 2003/0106656 | A1 | 6/2003 | Johnson et al. | |
| 2004/0123965 | A1 | 7/2004 | Isometsa et al. | |
| 2006/0162881 | A1 * | 7/2006 | Conn et al. | 162/111 |
| 2007/0158045 | A1 * | 7/2007 | Sundqvist et al. | 162/281 |
| 2008/0023168 | A1 * | 1/2008 | Conn et al. | 162/281 |

FOREIGN PATENT DOCUMENTS

| | | | |
|---|---|---|---|
| DE | 10214392 | | 10/2003 |
| EP | 1 182 293 | A1 | 2/2002 |
| EP | 1 391 552 | A1 | 2/2004 |
| JP | 52 114715 | A | 9/1977 |
| JP | 6262145 | | 9/1994 |
| JP | 6346398 | | 12/1994 |
| JP | 111100790 | | 4/1999 |
| JP | 2002173887 | | 6/2002 |
| WO | WO 98/27279 | | 6/1998 |
| WO | WO 99/04091 | | 1/1999 |
| WO | WO 01/20077 | A1 | 3/2001 |
| WO | WO 03/097890 | A2 | 11/2003 |
| WO | WO 2004/005614 | A1 | 1/2004 |
| WO | WO 2004/005615 | A1 | 1/2004 |
| WO | WO 2006081502 | A1 * | 8/2006 |

* cited by examiner

CREPING BLADE

FIELD OF THE INVENTION

The present invention relates generally to creping blades, and more specifically to creping blades and the like that have unique trailing edge geometry and/or an improved effectiveness.

BACKGROUND OF THE INVENTION

Doctor blades have been used for years in various different applications. Typically, a doctor blade is used to help separate a material from a piece of equipment. For example, a doctor blade may be used to help remove a web of material from a drum or plate to which the material has been attached. Doctor blades may also be used to clean equipment and/or to impart one or more characteristics into the product being manufactured by the equipment.

In the paper industry, for example, doctor blades are often used to help remove the paper web from a drying drum, such as, for example, a Yankee dryer, to which the paper web is adhered. In certain papermaking processes, the doctor blade that removes the paper web from the drying drum or any other drum may also be used to crepe the paper to some degree. Such doctor blades are often referred to as "creping blades". The present invention is directed to creping blades, and more particularly to creping blades used in papermaking and other web making processes.

The geometry of the creping blade and the particular set-up configuration of the creping blade with respect to the equipment with which it interacts can provide for variations in the way the creping blade performs its intended function. For example, it is known that the bevel or angle on the blade can affect the blades performance and/or the physical characteristics of the material being removed by the blade. Further, it is known that the location of the blade against the equipment with which it is intended to interact and the angle of the blade to that equipment can also provide for variations in the performance of the manufacturing process as well as the physical characteristics of the material being removed by the blade.

Despite the vast amount of information available relating to the bevel or angle of the doctor blade and/or the set-up configuration of such blades for different machine processes, there is still a need to improve the performance of creping blades and to provide creping blades that can uniquely affect the physical attributes of the materials with which they interact. Due to the way that a creping blade is typically used in the web making process (the web is removed from a drying roll at high speed by impacting the web against the creping blade), the creping blade can and does often cause problems with throughput, tearing of the web, reducing the strength of the web, generating dust, etc.

The present invention provides improved creping blades that address individually and/or together many of the problems presented by currently available creping blades. Specifically, it has been newly discovered that the geometry of the trailing edge or "heel" of the creping blade (the edge not positioned against or toward the piece of equipment with which the blade interacts) can be modified to provide unique benefits to the processes and/or materials with which the creping blade interacts. More specifically, it has been found that modifying the edge break at the heel of the blade can provide for improved machine performance, such as, for example, line speed increases, an increase in line reliability, an improvement in sheet stability, a reduction in the amount of dust or other material derived from the web interacting with the blade and/or can provide the product being manufactured with unique physical attributes not easily attainable by using the doctor blades that are currently commercially available. Further, the blades of the present invention can provide a less traumatic interaction with the paper web, which can help reduce the amount of material needed to form a particular end product in certain circumstances and/or allow for the use of less expensive materials to produce the desired end product.

SUMMARY OF THE INVENTION

The present invention addresses one or more of the disadvantages of currently available creping blades and methods using such creping blades by providing a creping blade comprising a body having a thickness, a leading side, a trailing side, and working end including a bevel surface. The bevel surface defined by a leading edge and a trailing edge, wherein the trailing edge of the creping blade is non-planar and has a trailing edge radius of greater than about 0.001 inches (about 0.0254 mm).

The present invention also includes a method of removing a material from a surface of a piece of equipment. The method comprises a) providing a material on the surface of the piece of equipment; b) providing a creping blade adjacent the surface of the equipment, the creping blade having a working end including a leading edge which is disposed closest to the surface of the equipment, a trailing edge disposed farthest from the surface of the equipment and a bevel surface disposed therebetween; c) passing the surface of the equipment past the creping blade or the creping blade past the surface of the equipment such that the material impacts the creping blade and at least a portion of the material is removed from the surface of the piece of equipment; d) providing at least some crepe in the material removed from the surface of the equipment; e) passing the creped material over the trailing edge of the creping blade, wherein the trailing edge of the creping blade has a trailing edge radius of at least about 0.001 inches (about 0.0254 mm).

DETAILED DESCRIPTION OF THE INVENTION

Figure 1A:
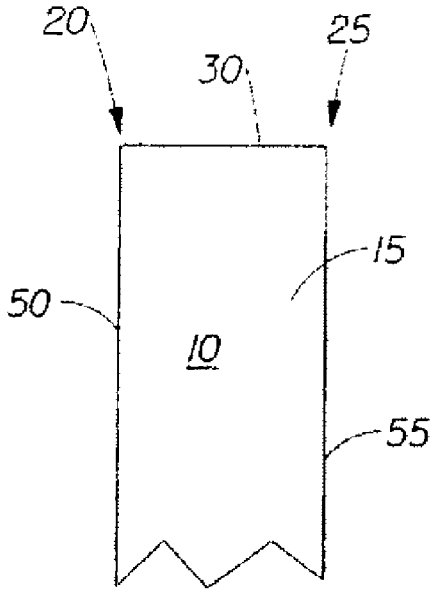
Fig. 1A (prior art)
FIGS. 1(A)-(D) are partial, enlarged, cross-sectional views of various prior art creping blades.
Figure 1B:
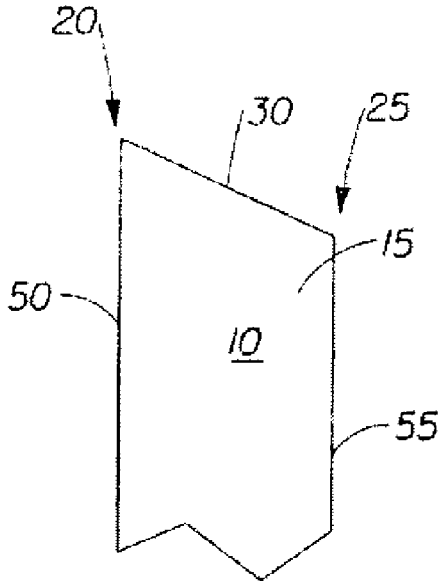
Fig. 1B (prior art)
Figure 1C:
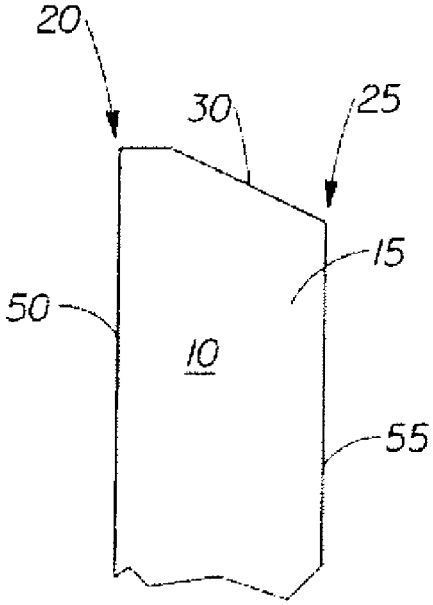
Fig. 1C (prior art)
Figure 1D:
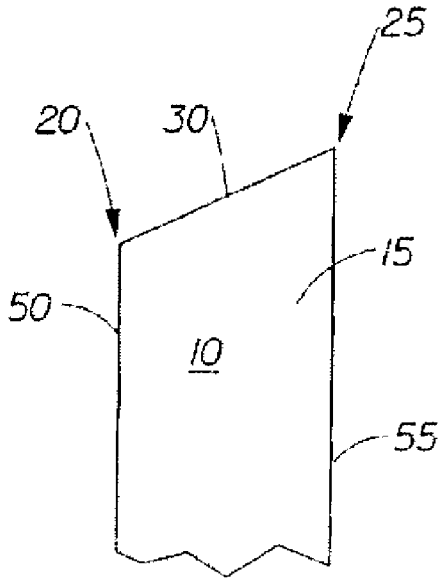
Fig. 1D (prior art)

As noted above, the present invention is directed generally to improved creping blades, which is a particular type of doctor blades. As used herein, the term "doctor blade" refers to a blade that is disposed adjacent another piece of equipment, for example a drum or plate, such that the doctor blade can help remove from that piece of equipment a material that is disposed thereon. Doctor blades are commonly used in many different industries for many different purposes, such as, for example, their use to help remove a web or mat from a drum in papermaking, nonwovens manufacture, and the tobacco industry, as well their use in printing, coating and adhesives processes. In certain instances, doctor blades are referred to by names that reflect at least one of the purposes for which the blade is being used. For example, a doctor blade used in the papermaking industry to remove a paper web from a drum and to provide some "crepe" or fold to the web might be referred to as a "creping blade". Similarly, a doctor blade used to clean a surface might be referred to as a "cleaning blade". In terms of this application, however, the focus will be on creping blades that have the dual function of removing a web from a piece of equipment, such as, for example a Yankee dryer, and providing the web with crepe.

FIGS. 1(A)-1(D) are representative examples of creping blades currently available in the market. In each case, an enlarged cross-section of the working end of the blade 10 is shown. The working end 15 of the blade 10, or that portion of the blade 10 placed in contact with or adjacent to the corresponding equipment from which the web, mat or other material is to be removed, has a leading edge 20, a trailing edge 25 and a bevel surface 30. The leading edge 20 is that portion of the blade 10 that is disposed between the leading side 50 of the blade 10 and the bevel surface 30. The leading edge 20 of the blade 10 is typically disposed closest to the corresponding piece of equipment, such as drum 35, shown in FIG. 2. The trailing edge 25 is that portion of the blade that is located between the bevel surface 30 and the trailing side 55. The trailing edge 25 is typically disposed farther from the corresponding equipment from which the material is being removed than the leading edge 20. Thus, the trailing edge 25 is typically located downstream from the leading edge 20. What this means is that from a process flow standpoint, the trailing edge 25 is later in the process than the leading edge 20. This can be seen in FIG. 2, where the leading edge 20 is closer to drum 35 than the trailing edge 25 of the blade 10 and that the trailing edge 25 is located downstream of the leading edge 20.

Figure 2:
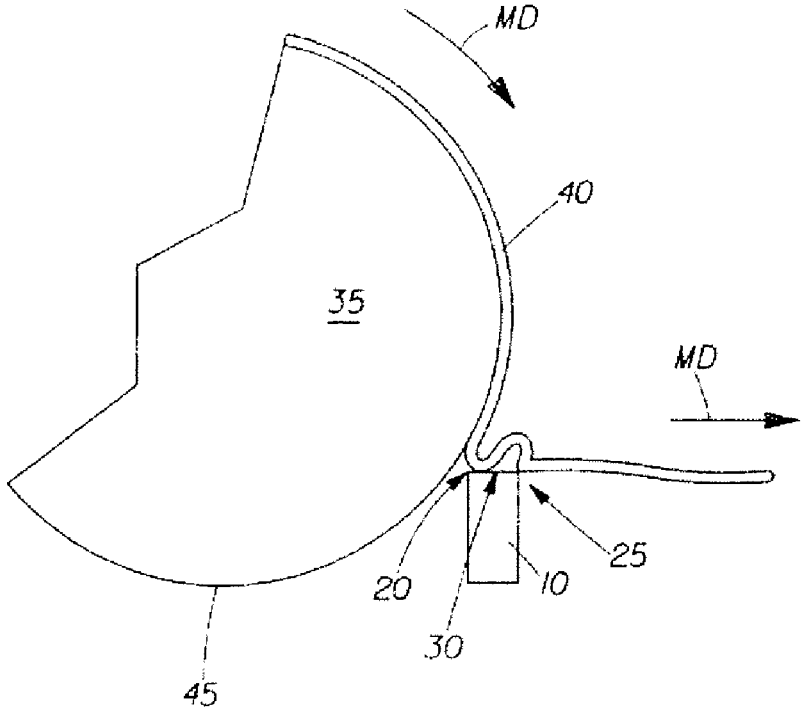
Fig. 2 (prior art)
FIG. 2 is a depiction of a creping blade of the prior art being used to remove a material from a roll.

FIG. 2 is a depiction of a portion of an exemplary embodiment of a typical papermaking process including the use of a creping blade 10 representative of those commercially available to remove a paper web 40 from a drum 35. As shown, the web 40 moves in the machine direction MD along the surface 45 of the drum 35 until it impacts the leading edge 20 of the doctor blade 10. In this case, the creping blade 10 removes the web 40 from the drum 35 and also provides "crepe" or micro and/or macro folds in the web 40 before it passes over the trailing edge 25 of the blade 10.

Figure 3:
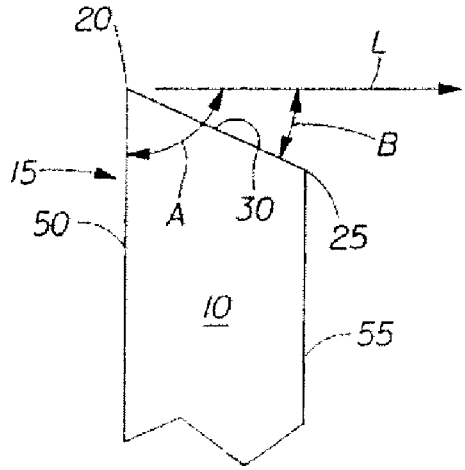
Fig. 3 (prior art)
FIG. 3 is an enlarged cross-sectional view of a creping blade showing the bevel angle.

FIG. 3 is an enlarged view of the working end 15 of a creping blade 10 showing the bevel angle B of the blade 10. As used herein, the term "bevel angle" refers to the angle between the bevel surface (or a line parallel thereto) and a line that is perpendicular to the leading side 50 of the blade 10. Thus, in FIG. 3, the angle A is 90 degrees and the bevel angle B is the angle between the bevel surface 30 and the line L. (In embodiments, where the bevel surface is above the line L so as to make an obtuse angle with respect to the leading edge 50, the bevel angle B can be expressed as a negative number of degrees.)

Figure 4:
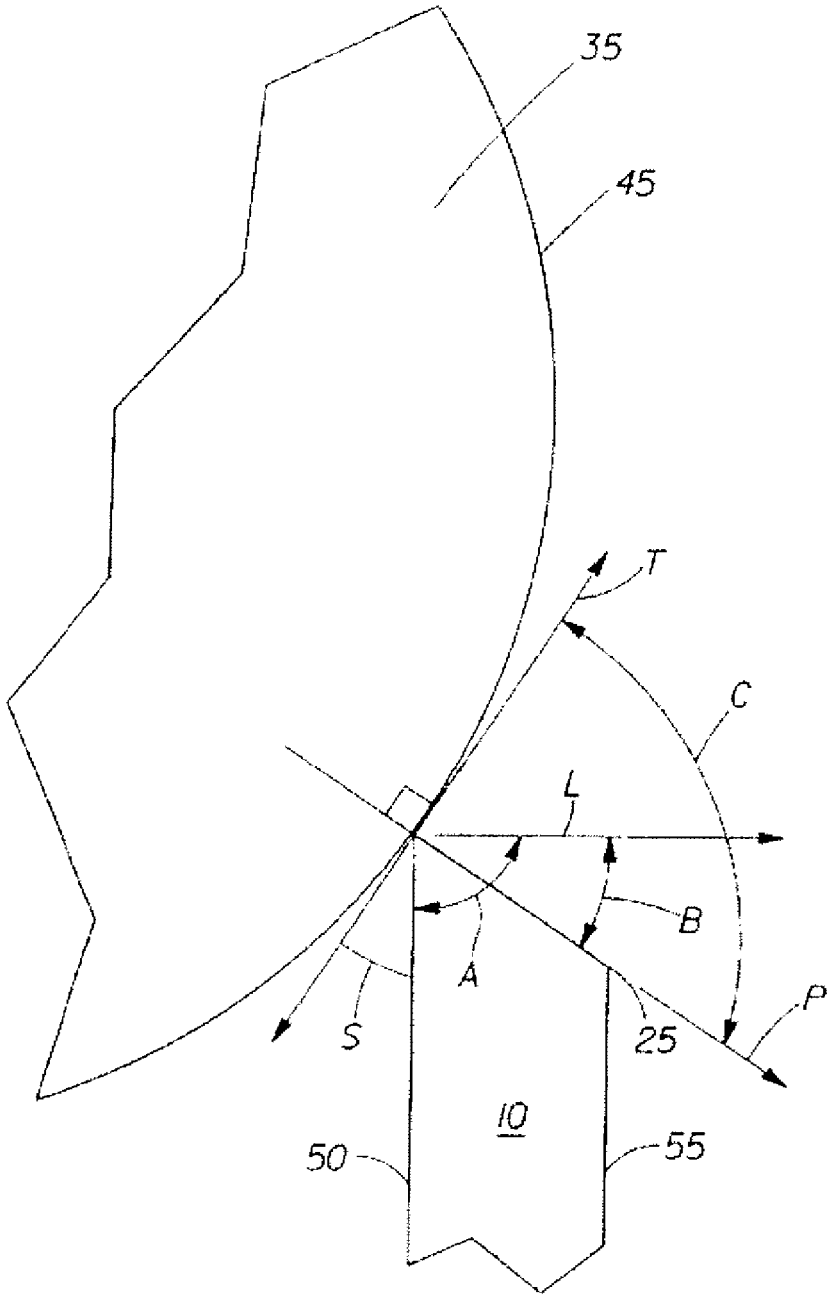
Fig. 4 (prior art)
FIG. 4 is a depiction of the set-up of a creping blade adjacent a drum showing the bevel angle and the impact angle of the doctor blade.
Figure 5:
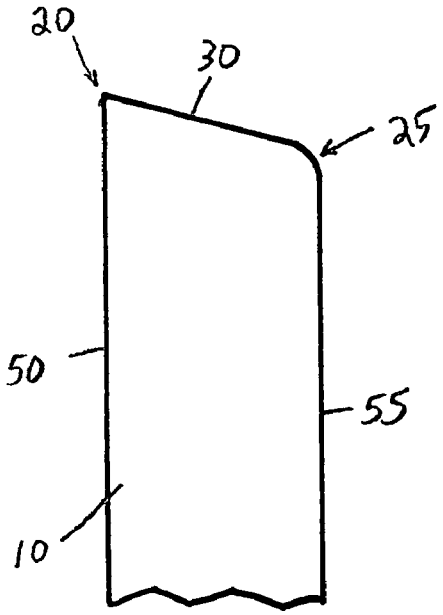
FIG. 5 is a partial, enlarged, cross-sectional view of one embodiment of a creping blade of the present invention.
Figure 6:
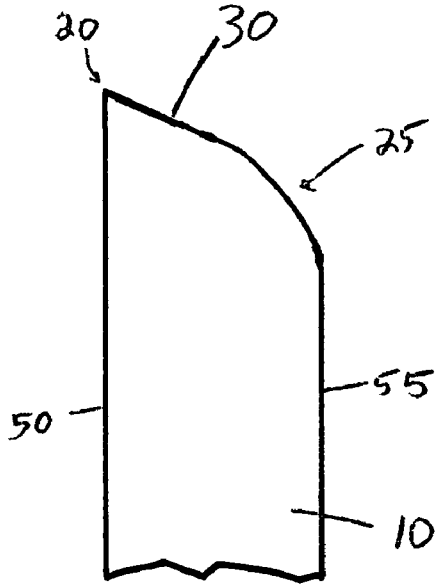
FIG. 6 is a partial, enlarged, cross-sectional view of one embodiment of a creping blade of the present invention.

FIG. 4 is a depiction of one embodiment of the set-up of a creping blade 10 with respect to the drum 35 off of which the creping blade 10 will be used to remove a material, such as a web. Angles A and B represent the same angles set forth in FIG. 3. That is, angle A is 90 degrees and runs between the leading side 50 of the blade 10 and the line L. The bevel angle is angle B. Angle C is the "impact angle" and refers to the angle between the line P which is parallel to the bevel surface 30 and the line T which is tangent to the surface 45 of the drum 35 where the creping blade 10 touches or is closest to the drum surface 45. The set-up angle S is the angle between the line T and the leading edge 50 of the blade 10. (It should be noted that the set-up angle can vary and that the set-up angle S shown in the figure is merely an example of one possible set-up angle.)

Although it has been known for some time that the geometry of the leading edge 20, the bevel angle B and the impact angle C of the creping blade 10 may affect the process in which the blade 10 is used as well as the physical attributes of the material (in this case, web 40) contacted by the creping blade 10, it has heretofore been unknown that the geometry of the trailing edge 25 of the creping blade 10 may also have a significant affect on the process and/or material contacted by the creping blade 10. Typically, creping blades 10 are provided with a sharp leading edge 20 and a generally planar bevel surface 30. This leads to a blade 10 with a sharp trailing edge 25 as well. As used herein, the term "sharp" refers to an edge that has a radius of curvature of less than about 0.001 inches (about 0.0254 mm).

Although not wishing to be limited by theory, it is believed that in certain manufacturing processes, such as, for example, papermaking, the web 40 impacting the creping blade 10 is forced across the trailing edge 25 of the blade in such a way that the trailing edge 25 provides significant friction and drag forces on the web 40. For webs, such as nonwoven webs and paper webs, such friction can reduce the tensile strength of the web, separate or dislodge material from the web (e.g. fibers) which can in turn generate dust or debris, slow throughput, increase web breaks, increase scrap, increase machine downtime and or increase equipment damage. Further, the blades 10 of the present invention can provide a less traumatic interaction with the materials with which they interact, which can help reduce the amount of material needed to form a particular end product in certain circumstances and/or allow for the use of less expensive materials to produce the desired end product. The present invention is directed to the unique geometry of the trailing edge 25 of the creping blade 10, the methods for using such creping blades 10 and the effects that such blades 10 have on the processes and materials with which they interact.

Specifically, the present invention is directed to a creping blade 10 that has a trailing edge 25 that is not sharp, but rather is dull or blunt. As used herein, the terms "dull and "blunt" refer to an edge of a blade 10 that is non-planar and has a radius of curvature of greater than or equal to about 0.001 inches (about 0.0254 mm), as described herein. As used herein, the term non-planar includes any shape that is not flat, or planar.

Figure 9:
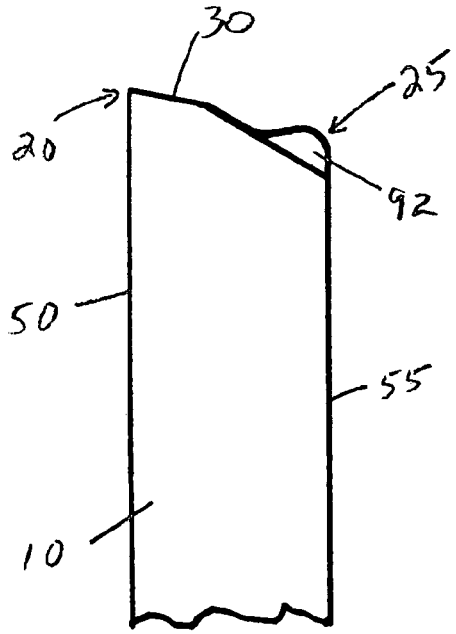
FIG. 9 is a partial, enlarged, cross-sectional view of one embodiment of a creping blade of the present invention.
Figure 10:
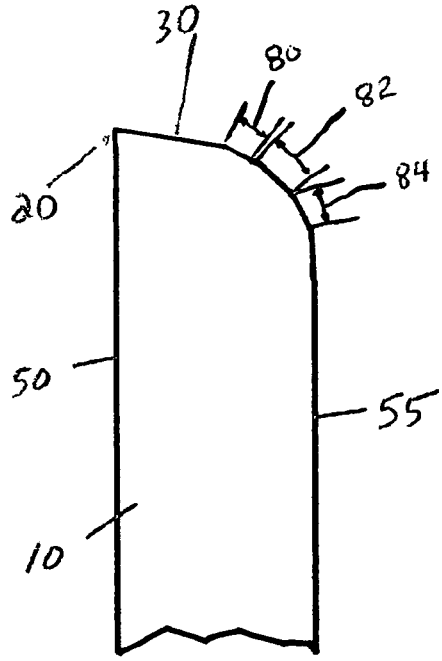
FIG. 10 is a partial, enlarged, cross-sectional view of one embodiment of a creping blade of the present invention.

The trailing edge 25 of the blade 10 can have any shape so long as it delivers the desired properties set forth herein. In certain embodiments, the trailing edge 25 is defined by a curve, a portion of a curve, or two or more curves together. More generally, the trailing edge 25, or any portion thereof may be in the shape of an arc, or a uniform or non-uniform portion of an ellipse, parabola, hyperbola or any conic section that provides the desired shape. Further, it is contemplated that some or all of the trailing edge 25 can include planar regions that are disposed between other curved or planar regions to provide a multi-planar surface with the desired properties. So long as the trailing edge 25 is not sharp, as defined herein, or consists of a single planar region, the trailing edge 25 is considered non-planar and within the scope of the invention. Examples of just a few of the different shapes and configurations of the creping blades 10 of the present invention are shown in FIGS. 5-10. In FIG. 10, the blade 10 has a trailing edge 25 including several planar sections 80, 82 and 84 disposed adjacent to each other and set at slightly different angles from each other to provide the blunt surface of the trailing edge 25.

Figure 11:
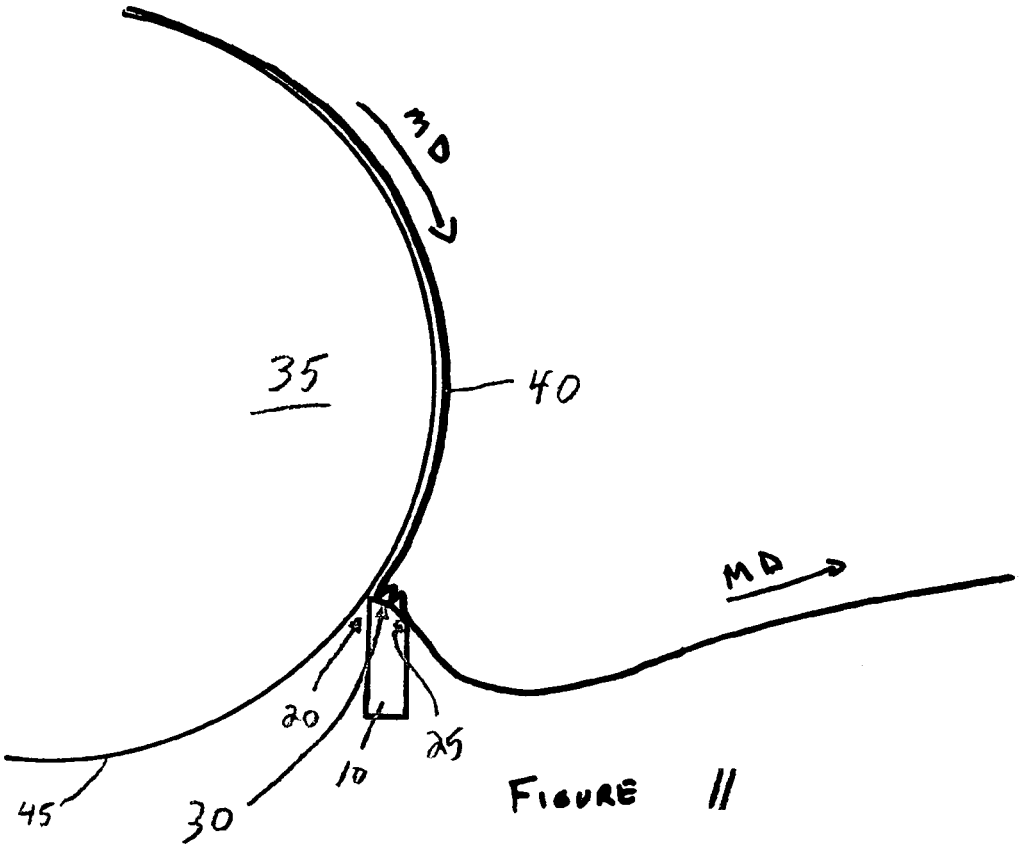
FIG. 11 is a depiction of one embodiment of a creping blade of the present invention being used to remove a material from a roll.

FIG. 11 shows an example of a creping blade 10 of the present invention disposed adjacent a drum 35, as it would be in a typical papermaking process. The web 40 is shown being removed from the surface 45 of the drum 35 by the creping blade 10. The creping blade 10 is also shown providing crepe to the web 40 before it passes off the bevel surface 30 of the blade 10. Due to the particular geometry of the trailing edge 25 of the blade 10, the web 40 can more easily flow off the trailing edge 25 as it moves away from the blade 10 in the machine direction MD. It is this point in the process where the benefits of the blades 10 of the present invention are believed to be achieved. As shown in FIG. 2, typical creping blades currently in the market have a sharp (i.e. not blunt) trailing edge 25 that provides a relatively great deal of friction against the web 40 as the web exits the bevel surface 30 of the blade. The friction generated between the web 40 and the trailing edge 25 of the blade is believed to be responsible for many of the negative factors set forth herein with respect to current creping techniques. The blunt geometry of the trailing edge 25 of the blades 10 of the present invention provide relatively less friction against the web 40 than current blades 10 and thus are able to reduce many of the negatives associated with creping. It has been found, for example, that such blades 10 can provide for improved web control, improved sheet stability, increased line speeds, better machine reliability, and/or improved caliper or other product attributes.

Figure 12:
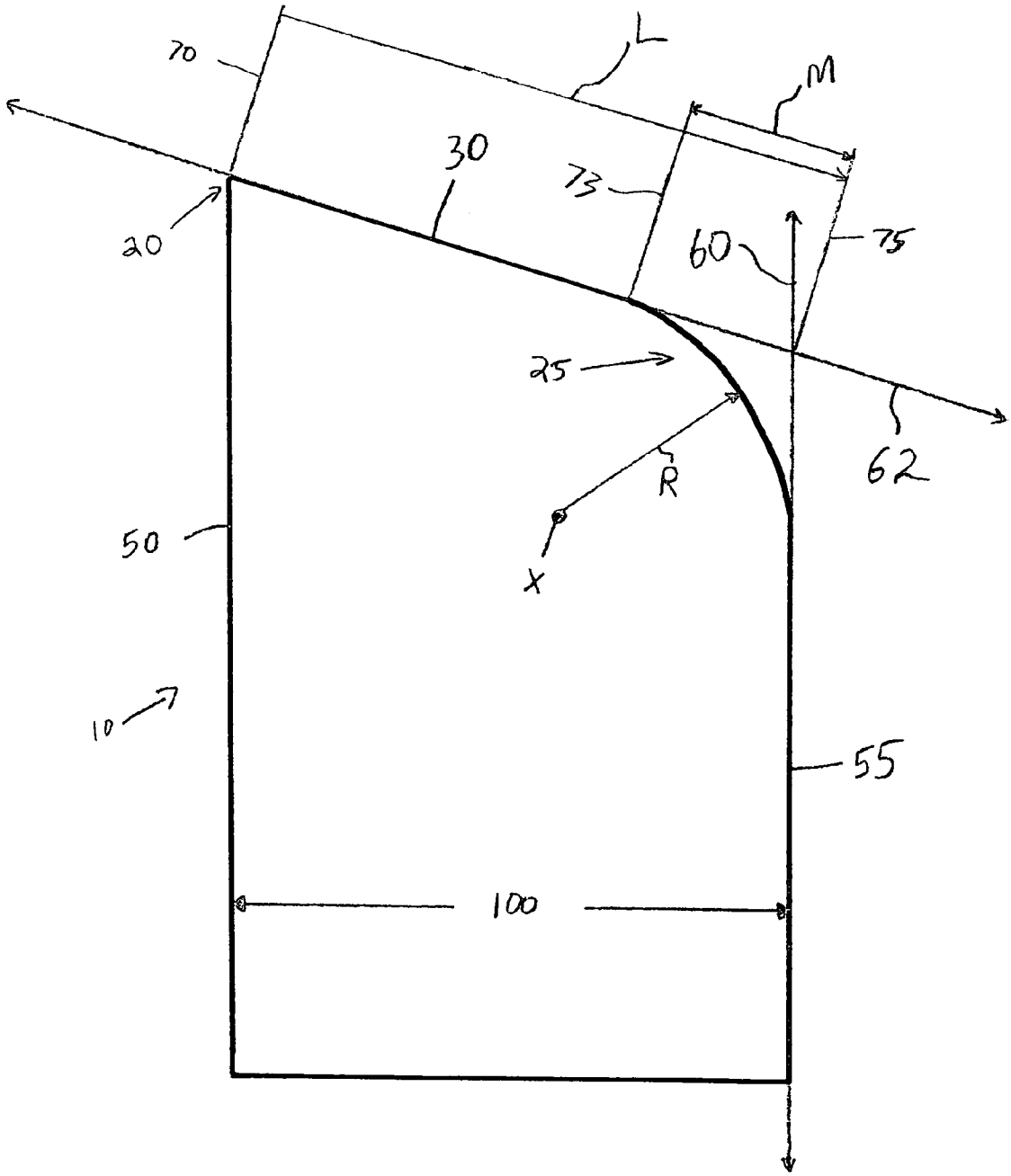
FIG. 12 is a partial, enlarged, cross-sectional view of one embodiment of a creping blade of the present invention.

In certain embodiments, it may be desirable for the trailing edge 25 of the creping blade 10 to have a substantially uniformly curved shape, such as a portion of an arc. In such embodiments, the shape of the trailing edge 25 can be described as an arc having a certain radius R, as shown in FIG. 12. Further, it may be desirable that the shape of the trailing edge 25 is such that it is a uniformly shaped curve that is oriented such that the centerpoint X from which the radius R extends is about equidistant from the bevel surface 30 and the trailing side 55 of the blade 10. This provides the blade 10 with a trailing edge 25 that has a smooth and uniform curve (or arc) from the point at which it breaks from the bevel surface 30 to the point it meets the trailing side 55. As described in the Test Methods section, below, the trailing edge radius TER would be equal to the radius R in these situations.

In other embodiments, the trailing edge 25 may include a non-planar shape that is not uniform, but rather varies as it moves from the bevel surface 30 to the trailing side 55. In such embodiments, the trailing edge radius TER is determined according to the methods set forth below to approximate the radius of the curve closest to the bevel surface 30 of the blade 10. Although not wishing to be bound by theory, this is believed to be the best approximation of the effective radius of the trailing edge 25 because it is believed that the geometry of the trailing edge 25 closest to the bevel surface 30 has a greater affect on the web 40 being creped than the geometry of the trailing edge 25 closest to the trailing side 55 of the blade 10.

It has been found that for processes including removing paper webs from drying rolls and creping the tissue paper, the above-noted geometry for the trailing edge 25 is beneficial. More specifically, it has been found that a trailing edge 25 with a non-planar geometry between the bevel surface 30 and the trailing side 55 of the blade 10 wherein the trailing edge radius is greater than or equal to about 0.001 inches (about 0.0254 mm), greater than or equal to about 0.002 inches (about 0.051 mm), greater than or equal to about 0.003 inches (about 0.076 mm), is suitable. Further, it may be desirable that the trailing edge radius TER be between about 0.001 inches (about 0.0254 mm) and about 100% of the thickness T of the blade 10, or between about 0.002 inches (about 0.051 mm) and about 100% of the thickness T of the blade 10 or between about 0.003 inches (about 0.076 mm) and about 100% of the thickness T of the blade 10. Alternatively, it may be desirable that the trailing edge radius TER be between about 0.001 inches (about 0.0254 mm) and about 0.1 inches (about 2.54 mm), or between about 0.002 inches (about 0.051 mm) and about 0.05 inches (about 1.27 mm) or between about 0.003 inches (about 0.076 mm) and about 0.05 inches (about 1.27 mm).

Figure 7:
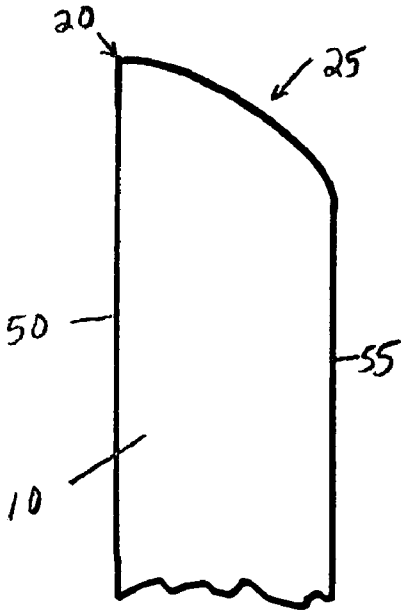
FIG. 7 is a partial, enlarged, cross-sectional view of one embodiment of a creping blade of the present invention.
Figure 8:
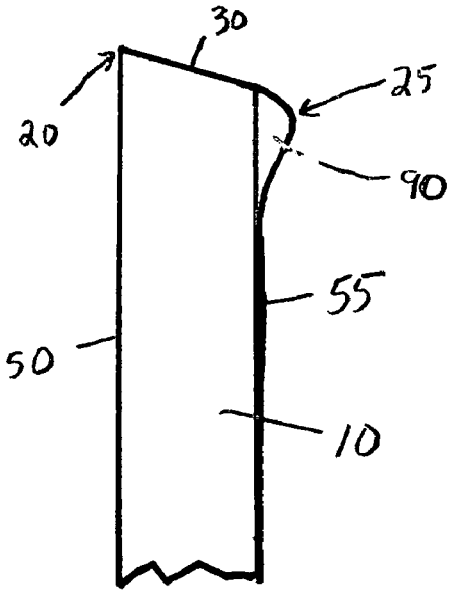
FIG. 8 is a partial, enlarged, cross-sectional view of one embodiment of a creping blade of the present invention.

The amount of the bevel surface 30 that is displaced by the trailing edge 25 can affect the functionality of the creping blade 10. That is, the amount of the bevel surface 30 that is not generally planar and disposed at the bevel angle B, but rather has been formed or modified to become part of the trailing edge 25 may be relevant in certain operations. Accordingly, it may be desirable to limit the amount of the bevel surface 30 that is displaced by the trailing edge 25. For example, as shown in FIG. 7, the entire bevel surface 30 has become part of the curved geometry of the trailing edge 25. Although this configuration may be desirable in some embodiments for some processes, it may not be suitable for other processes. Thus, in certain embodiments, it may be desirable to limit the length M of the trailing edge 25 to a certain percentage of the length L of the bevel surface 30. As used herein, the length L of the bevel surface 30 is the distance between the leading side 50 and the trailing side 55 when measured at the bevel angle B. This is shown in FIG. 12 as the length between the line 70 which is perpendicular to the bevel surface 30 and extending from the juncture of the bevel surface and the leading side 50 and the line 75 which is also perpendicular to the bevel surface 30, but is located at the intersection of lines 60 and 62 which are parallel to the bevel surface 30 and the trailing side 55, respectively. The length M of the trailing edge 25 is that portion of the length L of the bevel surface 30 that the trailing edge 25 takes up. Thus, the length M of the trailing edge 25 is measured along the same line as the length L of the bevel surface 30, but is measured from the point the trailing edge 25 breaks away from the planar portion of the bevel surface 30 (represented by line 73) to the line 75. Measurement of the lengths L and M of the bevel surface 30 and trailing edge 25, respectively, can be made from the images produced to measure the trailing edge radius TER, as set forth in the Test Methods section below.

In certain embodiments, it may be desirable to limit the length M of the trailing edge 25 to less than about ¾ of the length L of the bevel surface, ½ of the length L of the bevel surface 30, less than about ⅓ of the length L of the bevel surface 30, or less than about ¼ of the length L of the bevel surface 30. Limiting the length M of the trailing edge 25 may help maintain the creping attributes of the blade 10 while still allowing for the improved friction reduction provided by the blunt trailing edge 25.

Similarly, it may be desirable to provide a minimum length M of the trailing edge 25. This will help ensure that the trailing edge 25 is blunt enough to provide the improved functionality. For example, it may be desirable for the length M of the trailing edge 25 be at least about 0.001 inches (about 0.025 mm). Further, it may be desirable that the length M of the trailing edge 25 be between about 0.001 inches (0.025 mm) and about 0.01 inches (0.254 mm). In yet other embodiments, it may be desirable that the length M of the trailing edge 25 be between about 0.003 inches (0.076 mm) and about 0.01 inches (0.254 mm).

The geometry of the trailing edge 25 of the doctor blade 10 may be provided by any known means, including, but not limited to casting or otherwise providing the trailing edge 25 as desired and/or sanding, melting, cutting, scraping, grinding, polishing, hammering, and/or otherwise mechanically or thermally or modifying the trailing edge 25 to provide the desired geometry. Further, the geometry of the trailing edge 25 of the blade 10 can be provided with a coating 92 on all or a portion of the trailing edge 25 or all or portions of the bevel surface 30 and/or trailing side 55 adjacent the trailing edge 25, one example of which is shown in FIG. 9. Further still, the shape of the trailing edge can be provided by welding or otherwise permanently or non-permanently joining a separate material 90 to the doctor blade 10 at or near the trailing edge 25, as shown, for example in FIG. 8. In certain embodiments, the trailing edge 25 geometry may be modified by chemically, electrochemically and/or electrically altering a portion of the blade adjacent the trailing edge 25.

The creping blades 10 of the present invention can be used for any purpose and should not be considered to be limited to the examples set forth herein. As noted above, creping blades 10 are typically used to help remove a material from the surface of a piece of equipment, wherein the surface of the piece of equipment moves past the creping blade 10 or the blade 10 moves over the surface of the piece of equipment on which the material to be removed is disposed. Further, the creping blade 10 can have more than one purpose or use in the process in which it is used. Often, creping blades 10 are used not only to remove material from a passing surface and crepe the material, but also to cut the material, split the material, scrape a surface, clean a surface and/or provide a means for controlling the material that is being removed, such as, for example, to provide a directional change or tension point for controlling a moving web. One or more of these functions can be provided by a single blade 10 or can be provided by two or more blades 10 in a manufacturing process. If two or more creping blades 10 are used, the blades 10 can be the same or differ in their geometry, make-up, or any other attribute as well as their intended use and location in the process.

The creping blades 10 of the present invention can be made from any material or materials suitable for the particular purpose of the creping blade 10, whether the material(s) is now known or later becomes known. For example, creping blades 10 are often made from metals, ceramics or composite materials, but can also be made from plastic, carbon, glass, stone or any other suitable material or combination of materials. Further, the creping blade 10 may vary in any of its dimensions, such as height, length and/or thickness, as well as bevel angle B and the geometry of any side and/or surface of the blade 10. The creping blade 10 can be a single-use blade or a blade that is reused with or without being reground, refurbished or otherwise restored to allow the blade 10 to be reused after it has been taken out of service for any particular reason. The creping blade 10 can have only a single working end 15 or can have two or more working ends (for purposes of simplification, the creping blades 10 shown herein have a single working end 15). Further, the creping blade 10 could have multiple leading edges 20 and trailing edges 25 on any working end 15.

Suitable creping blades 10 for use in a papermaking process are, for example, creping blades available from ESSCO Incorporated of Green Bay, Wis. and/or James Ross Limited of Ontario, Canada. The blades 10 are made from a martensitic stainless steel and have dimensions of about 200 inches (about 5080 mm) in length, about 5.5 inches (about 139.7 mm) in height and about 0.05 inches (about 1.27 mm) in thickness. The blade 10 can have any bevel angle B, but it has been found that a bevel angle B between about 0 degrees and about 45 degrees may be suitable for tissue and/or towel applications. The blades 10 each have a sharp leading edge 20 and trailing edge 25, as described herein. However, the trailing edge 25 is modified in accordance with the present invention such that, for example, the trailing edge 25 has a curvature of radius of greater than about 0.003 in (about 0.076 mm). The modified geometry of the trailing edge 25 may be provided by grinding or otherwise removing material from the trailing edge 25 that is provided by the blade manufacturer. Of course, the manufacturer could also provide the desired blade geometry.

As noted above, one factor closely related to the geometry of the trailing edge 25 of the creping blade 10 and the benefits associated with the blades 10 of the present invention is the amount of friction that the trailing edge 25 will provide when the web 40 is forced over the trailing edge 25 after the web 40 is creped. For paper tissue and paper towel manufacturing processes, it has been found that a reduction in the coefficient of friction between the trailing edge 25 of the blade 10 and the web 40 can lead to improvements in the performance of the manufacturing line as well as improvements in the quality of the end product. Thus, one factor to consider when designing a creping blade 10, regardless of the particular shape of the blade 10 is the coefficient of friction associated with passing the trailing edge 25 of the blade across the portion of the web that would be stuck to the Yankee dryer and thus forced against the trailing edge 25 of the blade 10 during the manufacturing process. In certain embodiments, the coefficient of friction can be reduced by the geometry of the trailing edge 25 of the blade 10, alone. In other embodiments, polishing or coatings can be used in addition to or as an alternative to any shaping of the trailing edge 25.

To simulate the interaction between the trailing edge 25 of the blade and a web 40 and to show the reduction in coefficient of friction that can be achieved by blunting the trailing edge 25 of the blade 10, the Coefficient of Friction Test set forth in the Test Methods section was used. The method was performed with five different creping blade samples and eight different web samples, as described in more detail below. The five blade samples were cut from actual creping blades to fit the probe used in the testing. The trailing edge radius TER of the samples was determined by the method set forth below.

The following table, Table 1, shows the results of the measurements made on the different blade samples to determine trailing edge radius TER, as well as the length M of the trailing edge 25, as described above. Blades 1, 2 and 5 were modified according to the present invention. Blades 3 and 4 are commercial samples of the same type of blade, except that blade 4 was run on a papermaking machine for eight hours.

TABLE 1

| Blade | $R_{minor}$ | $R_{major}$ | M |
|---|---|---|---|
| 1 | 0.0037 in (0.094 mm) | 0.0037 in (0.094 mm) | 0.0022 in (0.0559 mm) |
| 2 | 0.0013 in (0.033 mm) | 0.0053 in (0.135 mm) | 0.0017 in (0.0432 mm) |
| 3 | 0.0006 in (0.015 mm) | 0.0006 in (0.015 mm) | 0.0002 in (0.0051 mm) |
| 4 | 0.0006 in (0.015 mm) | 0.0006 in (0.015 mm) | 0.0003 in (0.0076 mm) |
| 5 | 0.0240 in (0.610 mm) | 0.0240 in (0.610 mm) | 0.0116 in (0.2946 mm) |

Blade 1 is a creping blade from Essco Inc. The blade has a thickness T of 0.050 inches (about 1.27 mm) and is made from a martensitic stainless steel at about 45 to 49 Rockwell C. The bevel angle of the blade is 16 degrees. The trailing edge of the blade was modified according to this invention to be a smooth symmetrical arc. The trailing edge radius is 0.0037 inches (about 0.094 mm).

Blade 2 is a creping blade from Essco Inc. The blade has a thickness T of 0.050 inches (about 1.27 mm) and is made from martensitic stainless steel at about 45 to 49 Rockwell C. The bevel angle of the blade is 16 degrees. The trailing edge of the blade has been modified according to the present invention to provide a blunt trailing edge. The trailing edge radius of the blade is 0.0013 inches (about 0.033 mm).

Blade 3 is a creping blade from James Ross Limited. The blade has a thickness T of 0.050 inches (about 1.27 mm) and is made from AISI 420 SS at about 44 to 48 Rockwell C. The bevel angle of the blade is 16 degrees. The trailing edge of the blade has not been modified in any way. The trailing edge of the blade is a sharp edge and has a trailing edge radius, as measured by the methods set forth herein of about 0.0006 inches (about 0.015 mm).

Blade 4 is a creping blade from James Ross Limited. The blade has a thickness T of 0.050 inches (about 1.27 mm) and is made from AISI 420 SS at about 44 to 48 Rockwell C. The bevel angle of the blade is 16 degrees. The trailing edge of the blade has not been modified in any way. Blade 4 is the same as blade 3 except blade 4 was placed in operation against a Yankee drier on a through-air-dried papermaking machine for 8 hours. The trailing edge of the blade is a sharp edge and has a trailing edge radius, as measured by the methods set forth herein of about 0.0006 inches (about 0.015 mm).

Blade 5 is a creping blade from Essco Inc. The blade has a thickness T of 0.050 inches (about (1.27 mm) and is made from martensitic stainless steel at about 45 to 49 Rockwell C. The bevel angle of the blade is 16 degrees. The trailing edge of the blade was modified according to the present invention to be a smooth symmetrical arc. The trailing edge radius of the blade is 0.024 inches (about 0.610 mm).

The web samples that were tested were chosen to represent a variety of different paper webs, including creped and uncreped paper. The Puffs samples were a commercially available facial tissue product manufactured by The Procter & Gamble Company. The samples were taken from a long carton containing 108 2 ply tissue samples. The UPC Code for the box was 37000 33547. The two plies were separated and the outer side surface of the tissue was tested.

The Scott 1000 sample is commercially available from Kimberly Clark Corporation. The UPC Code on the package was 54000 44700. The outward facing surface on the roll was tested.

The Hewlett Packard ink jet paper is commercially available from Hewlett Packard, Palo Alto, Calif. The package was labeled "HP Bright White Ink Jet Paper 24lb, HPB250". The UPC Code on the package was 64025 20301. The top side facing the top of the package was tested in the 11 inch direction.

The Uncreped Tissue Paper tested is commercially available from Hallmark Cards. The package was labeled "Hallmark Brand XTU 534E, (36 $ft^2$–3.34 $m^2$ 10 Sheets (50.8×66 cm)". The UPC Code on the package was 09200 19065. The outside as presented on opening the package was tested in the machine direction. The machine direction was determined by tearing the paper. The direction that tore straight was identified as the machine direction.

The Parchment Paper is commercially available from Reynolds Consumer Products. The package was labeled "Reynolds® Band 30 $ft^2$ (24 ft×15 in)". The UPC Code on the package was 10900 01331. The outside of the roll was tested in the long direction of the roll.

The Bounty, Charmin, and Puffs flat samples were obtained directly from The Procter & Gamble Manufacturing Company. The flats were samples of the different papers obtained from the reel. The samples did not contain added lotions or other materials intended to lubricate the surface of the web. The Yankee side of the paper was tested in the machine direction.

The following table, Table 2, shows the COF results of the testing performed. The different blades are listed by numbered down the left side of the table and the different paper products tested are listed across the top of the table.

TABLE 2

(COF)

| | Puffs | Scott 1000 | HP Ink Jet | Uncreped Tissue | Parchment | Bounty Flat | Puffs Flat | Charmin Flat |
|---|---|---|---|---|---|---|---|---|
| 1 | 0.460 | 0.466 | 0.391 | 0.275 | 0.151 | 0.489 | 0.485 | 0.587 |
| 2 | 0.574 | 0.559 | 0.504 | 0.385 | 0.285 | 0.532 | 0.529 | 0.576 |
| 3 | 0.727 | 0.795 | 0.690 | 0.564 | 0.446 | 0.789 | 0.762 | 0.821 |
| 4 | 0.745 | 0.821 | 0.668 | 0.592 | 0.471 | 0.771 | 0.763 | 0.861 |
| 5 | 0.243 | 0.241 | 0.285 | 0.191 | 0.141 | 0.273 | 0.282 | 0.368 |

It is clear from Table 2 that creping blades 10 that have been modified such that the geometry of the trailing edge 25 is blunt, as set forth herein, (e.g. blades 1 and 5) provide for significant and distinct reductions in the COF on all of the different paper samples against which the blades 10 were tested verses the blades that were not modified or were merely deburred by the manufacturer (blades 2, 3 and 4). It is believed that these significantly reduced COF properties provide for at least some of the advantages set forth herein with respect to the improved creping blades of the present invention. Specifically, it is believed that a COF value between the creping blade and the web of less than about 0.5, less than about 0.4, or less than about 0.3 may be advantageous in certain papermaking processes.

Test Methods

Laboratory Conditions:

All conditioning and testing is performed under TAPPI standard conditions 50.0%±2.0% R.H. and 23.0±1.0° C. (T204 om-88). All samples are conditioned for a minimum of 2 hours before testing.

Figure 13:
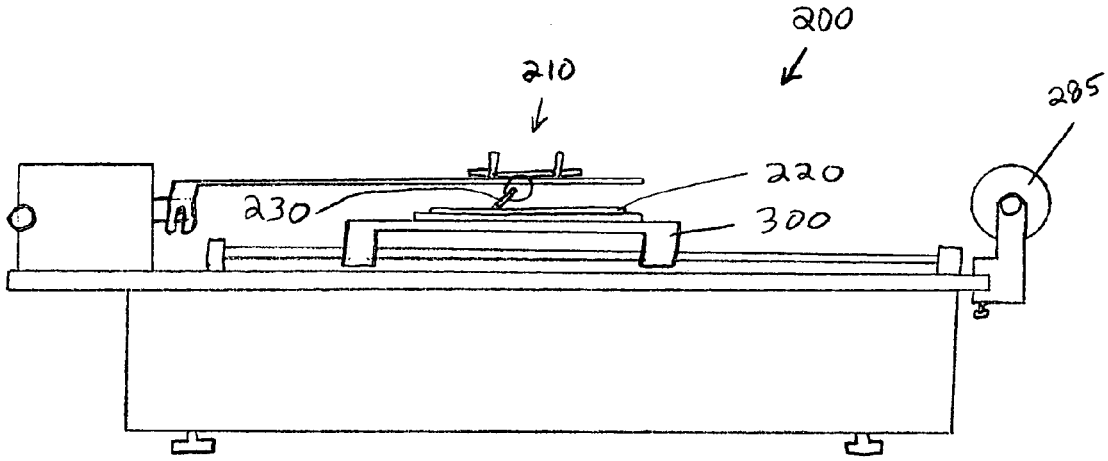
FIG. 13 is a representative sketch of a KES-SE surface analyzer that was used to test various different creping blades.
Figure 14:
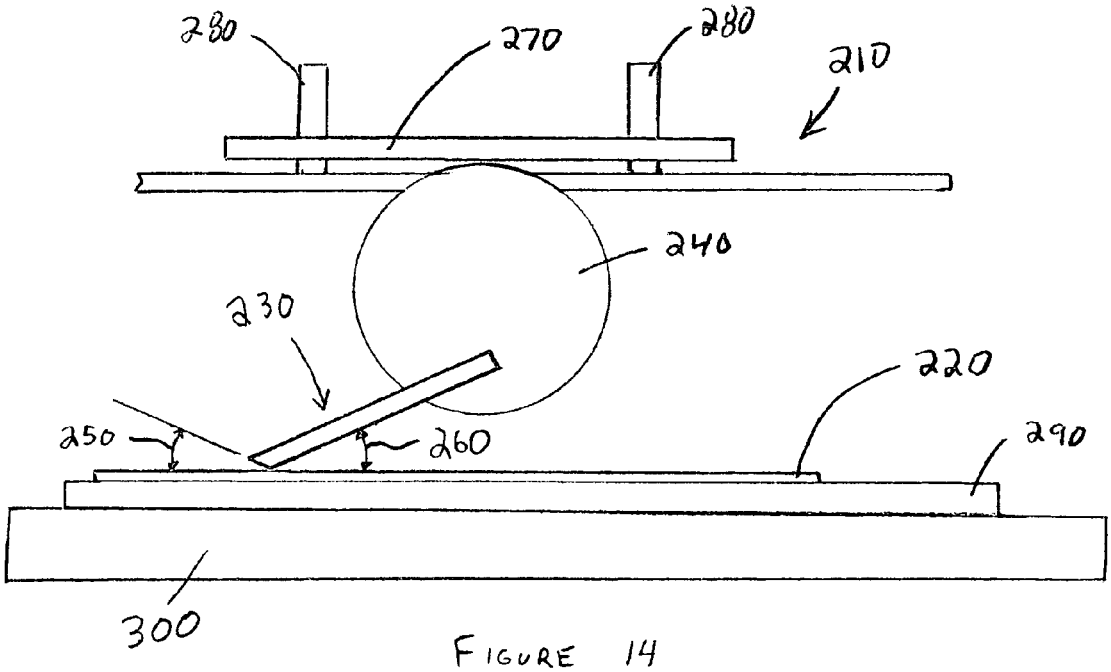
FIG. 14 is an enlarged view of the modified probe head used during the testing of the creping blades.

Coefficient of Friction:

The coefficient of friction is the average dynamic friction force divided by the normal force. The coefficient is dimensionless. Slip-and-stick coefficient of friction (hereinafter "S&S COF") is defined as the mean deviation of the coefficient of friction. Like the coefficient of friction, it is also dimensionless. The test is performed on a KES-SE surface analyzer with a modified friction probe, as shown in FIGS. 13 and 14. The surface tester 200 can be obtained from KATO TECH CO., LTD, Karato-Cho, Nishikiyo, Minami-Ku, Koyota, Japan. The instrument consists of a surface probe 210 attached to a force transducer which detects the horizontal force on the probe 210 as the sample 220 moves under the detection surface. The sample 220 moves with the instrument table 300 at a constant rate of 1 mm/second. The standard KES friction surface probe is modified, as shown in FIGS. 13 and 14, to accept a creping blade sample 230. The standard fingerprint sled is removed and a fabricated blade holder 240 is put in its place. The blade holder 240 is fabricated from aluminum. The blade holder 240 is approximately 1.385 inches (about 35.18 mm) long and 0.55 inches (about 13.97 mm) in diameter. The blade holder 240 is slotted to accept a blade sample 230. The blade sample 230 is held in the slot with set screws. The blade holder 240 with the screws weighs approximately 14 grams. The alignment of the blade sample 230 to the sample 220 is fabricated so the angle of incidence 250 of the blade on the sample is equal to angle of reflection 260. For a blade with a bevel angle of 16° the angle of incidence and angle of reflection are both 37°. The counter weight that is normally attached to the end of the probe 210 opposite the end attached to the load cell is also removed. A KES standard 25 gf weight is attached to the two posts 280 above the blade holder 240 designed to hold weights 270. This makes the total weight of the blade holding probe 210 without blades 47.75 gf. The design of the holder 240 and blade sample 230 is such that center of gravity is approximately at the point where the blade sample 230 touches the sample 220. The blade sample 230 is centered in the blade holder 240.

In the analysis, the surface tester 200 senses the lateral force on the probe 210 and integrates the force, as the sample 220 moves under the probe 210. This force is called the frictional force. Static friction is observed, but not recorded, at the start of the test. A total distance of 30 mm is scanned by the surface tester 200. The load cell voltage is filtered by the instrument and integrated between 5 and 25 mm ($L_{max}$=20 mm total). The data between 0-5 mm and 25-30 mm are discarded. All normal operating conditions of the surface tester 200 are used without modification, except for the change in the described probe 210. In the normal condition, the instrument signal passes through a low cut filter. It then passes through an absolute value circuit and then the output voltage is sent to the integral circuit. The resultant output for obtaining the friction at the end of a test is read on the digital display with the MIU button depressed. The integrated filtered voltage for friction, MIU is converted to a frictional force, F, by multiplying the MIU value by the calibration value CV. The calibration value CV is obtained by attaching a 20 gf weight on a thread to the load cell and hanging the thread across a pulley 285 at the opposite end of the instrument, as described by the manufacturer. The digital display voltage is adjusted to 1.00 volts. The surface tester 200 is set to scan. The time averaged integrated output voltage is recorded (A value of approximately 4.00 volt-time will be displayed on the digital display for an MIU reading). The calibration value CV then is 20 gf/4.00 volt-time or 5.00. The frictional force F is simply the value obtained by multiplying the output value MIU from the instrument by CV. The ratio of the frictional force F to the probe weight P (approximately 50 gf) is the coefficient of friction COF, μ. The surface tester 200 is used to solve the following equation to determine the COF for each sample:

$$\mu = COF = F/P$$

$$\mu = COF = \frac{1}{L\max}\int_0^{L\max} \mu\, dL$$

The samples 220 are scanned in the forward direction only. The average values from the forward scans of four samples 220 are obtained and reported. The surface tester 200 is run in the high sensitivity mode. The output voltage display from the MIU button is used to calculate the COF. The actual time integrated output voltage, MIU, obtained during calibration with the 20 gf weight was used to calculate the CV. The actual probe weight for each blade sample 230 is measured and a P value is obtained for each blade. The P value for each blade was used to determine the reported μ. The blade samples 230 measure approximately 1.2 inches (about 30.5 mm) long by about 0.4 inches (about 10.2 mm) wide by about 0.050 inches (about 1.27 mm) thick. The blade sample weight ranges from 2.95 to 3.01 grams. Thus, the total probe weight ranges from 50.70 to 50.76 gf. The probe 210 is positioned so the arm is parallel to the sample 220. The balance is tipped slightly so the probe 219 rested on the load cell arms. No force is exerted on the load cell before the test scan is begun.

Sample Preparation:

Paper samples for the test are affixed to glass microscope slides 290 (Microslides—VWR Scientific Inc, West Chester, Pa. 19380 Precleaned cat #43212-0002). The slides 290 are 25 mm×75 mm. The samples 220 are affixed to the slide using 3M double sided tape (2 inches (about 50.8 mm) wide). The sample 220 is prepared by cutting a 2 inch (about 50.8 mm) wide strip of paper; (the direction of the 2 inches is the machine direction) the surface to be tested is placed top surface down facing a clean table; and lightly pressing an adhesive tape covered slide onto the back side of the paper sample 220. Only a light pressure is exerted to obviate error inducing changes in the paper sample. The samples 220 are affixed with the machine direction (MD) running in the 2 inch length of the slide 290. The paper is trimmed at the edges using a sharp X-acto knife. Only samples 220 having no bubbles, wrinkles, or edge defects are tested. The slide 290 is held in position on the instrument table 300 with double sided tape. The sample is centered under the probe 210 such that the blade sample 230 is centered over the sample 220. The blade sample 230 overhangs the sample 220 by approximately 0.1 inches (about 2.5 mm) on each side. Four replicates for each paper sample 220 are measured and averaged. A fresh slide 290 is used for each replicate.

Trailing Edge Radius:

The trailing edge radius ("TER") dimension is calculated by obtaining a magnified image of the trailing edge 25 of the blade 10, importing the image into a cad program, and measuring the radius of curvature. Specifically, the blade 10 or a sample of the blade is positioned on edge on the stage of a dissecting microscope (NIKON SMZ1000). In this case, the blade samples 230 used to measure the COF were used to calculate the TER. A digital image is obtained through the photography port at 8× magnification using a Spot Insight Color Camera (Diagnostic Instruments, Inc) with a Nikon TV Relay lens 1×/16. The JPEG Image size is approximately 1.2 MB on the disk. The image is captured on a Macintosh Computer using Spot Ver 3.2.6 for the MAC (Diagnostic Instruments, Inc). The JPEG image is imported into PowerCADD Ver.6 Software for the MAC (Engineered Software, Greensboro, N.C.). The imported image is reduced by 50% to fit an 8.5×11 inch sheet. The dimensions of the image are determined using a calibrated stage ruler obtained by using the same set up as the photo images at the same magnification. This may result in a magnification of approximately 200 times on an 8.5×11 sheet.

The screen image may need to be rotated to adjust the image on the screen. If the curve of the trailing edge 25 appears to be substantially symmetrical, the image is adjusted so the trailing side 55 of the blade sample 230 is perpendicular to the bottom of the screen. When the shape of the trailing edge 25 is non-uniform, and the shorter portion of the curve is adjacent the bevel surface 30, the image is adjusted so the trailing side 55 of the blade sample 230 is perpendicular to the bottom of the screen. When the shape of the trailing edge 25 is non-uniform, and the longer portion of the curve is adjacent the bevel surface 30, the image should be rotated such that the bevel surface 30 is parallel to the bottom of the screen. This rotation will allow the PowerCADD ver6 program to draw the contour lines described below.

Figure 15:
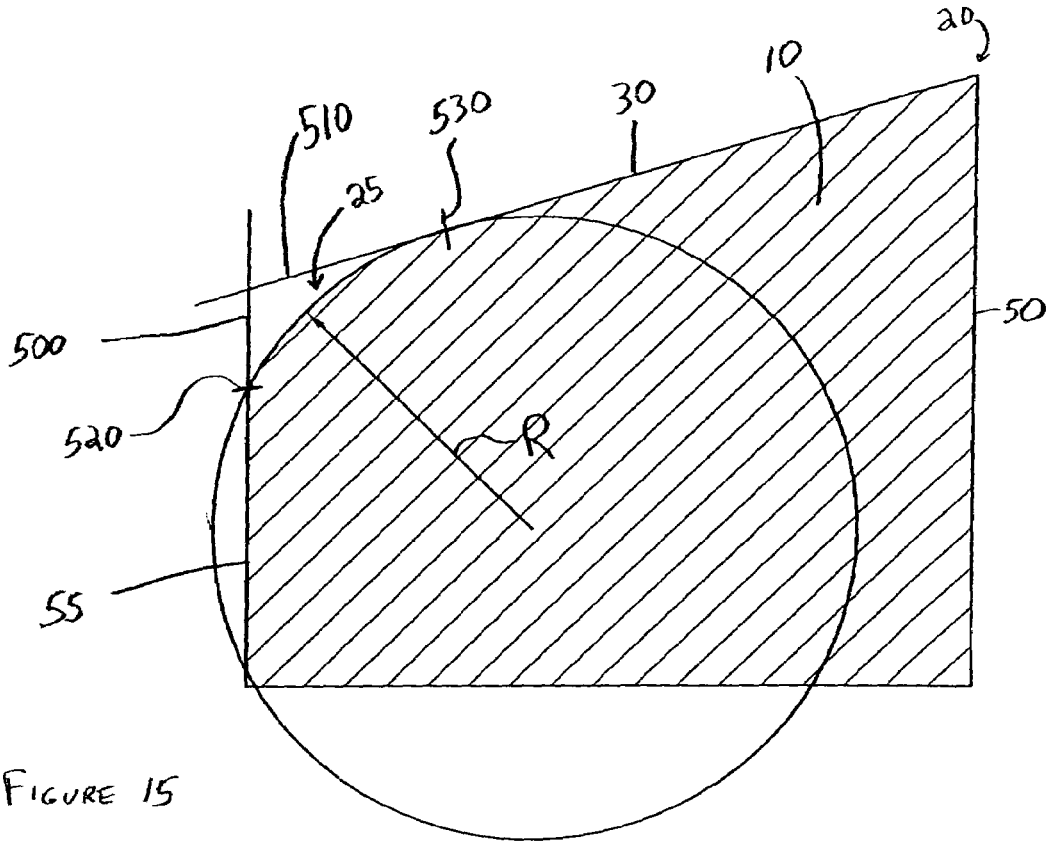
FIG. 15 is a representation of a portion of the method used to determine the trailing edge radius of a blade when the trailing edge that is substantially arcuate.
Figure 16:
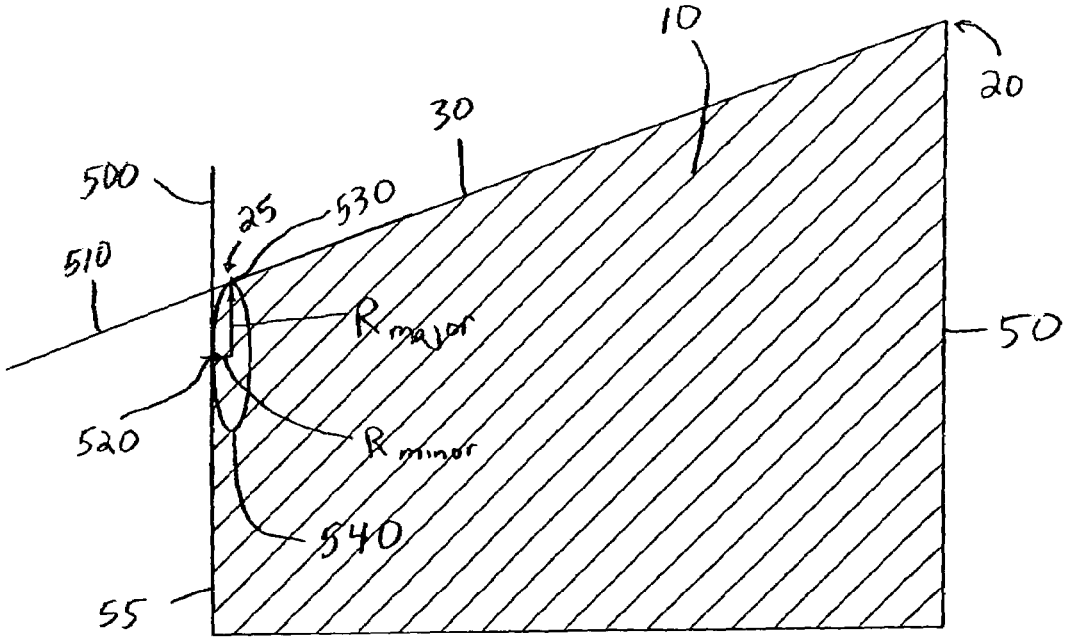
FIG. 16 is a representation of a portion of the method used to determine the trailing edge radius of a blade when the trailing edge is non-uniformly shaped.

The screen image can be increased or decreased as desired to position lines and reference marks as required. As shown in FIGS. 15 and 16, a straight line (trailing side line 500) is drawn along the trailing side 55 of the blade 10, touching the blade 10 along the trailing side 55 and extending above the bevel surface 30 of the blade 10. A second straight line (bevel line 510) is drawn along the bevel surface 30 from the leading edge 20 past the trailing edge 25 of the blade 10. An index mark 520 is made on the trailing side line 500 where the trailing side 55 of the blade 10 deviates from the trailing side line 500. Likewise an index mark 530 is made on the bevel line 510 where the blade 10 deviates from the bevel surface line 510. An arc by cord tool or an elliptical arc tool (whichever is more appropriate for the particular curve) is used to draw a contour line that approximates the shape of the blade 10 between the two index marks 520 and 530. The radius of curvature of the arc by cord is obtained from the edit-arc display. The radii of the major and minor axes ($R_{major}$ and $R_{minor}$, respectively) of the ellipse 540 are obtained from the edit-elliptical arc display.

If the non-planar region of the trailing edge 25 is substantially symmetrical, the radius R of the arc is used as the trailing edge radius TER. If the non-planar region of the trailing edge 25 is not substantially symmetrical, the radius of the portion of the curve closest to the bevel surface 30 is used to determine the trailing edge radius TER. Thus, for example, as shown in FIG. 16, the radius of the portion of the trailing edge 25 closest to the bevel surface 30 is measured to get the trailing edge radius TER. In the example shown in FIG. 16, the radius of the portion of the trailing edge 25 closest to the bevel surface 30 is the minor radius $R_{minor}$ of the ellipse 540.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creping blade comprising:

a body having a thickness, a leading side, a trailing side, and working end including a bevel surface;

the bevel surface defined by a leading edge and a trailing edge;

wherein the trailing edge of the creping blade is convex and has a trailing edge radius of greater than about 0.001 inches (about 0.0254 mm);

and wherein the trailing edge has a length that is less than about ¾ of the length L of the bevel surface.

2. The creping blade of claim 1 wherein the trailing edge radius is at least about 0.002 inches (about 0.051 mm).

3. The creping blade of claim 1 wherein the trailing edge radius is at least about 0.003 inches (about 0.076 mm).

4. The creping blade of claim 1 wherein the bevel surface has a length and the trailing edge has a length, and wherein the length of the trailing edge is no more that about ½the length of the bevel surface.

5. The creping blade of claim 1 wherein the trailing edge includes a substantially uniformly shaped arc, wherein the arc has a centerpoint and a radius and wherein the centerpoint from which the radius extends is about equidistant from the bevel surface and the trailing side of the blade.

6. The creping blade of claim 1 wherein the trailing edge includes a non-uniformly shaped curve.

7. The creping blade of claim 1 wherein at least a portion of the trailing edge is provided by coating the trailing edge of the creping blade to change its shape.

8. The creping blade of claim 1 wherein at least a portion of the geometry of the trailing edge is provided by joining a separate material to the creping blade at or adjacent the trailing edge to change its shape.

9. The creping blade of claim 1 wherein the trailing edge radius is between about 0.001 inches (about 0.0254 mm) and 100% of the thickness of the blade.

10. The creping blade of claim 1 wherein the trailing edge has a length of greater than or equal to about 0.001 inches (about 0.0254 mm) and the trailing edge radius is between about 0.001 inches (about 0.0254 mm) and 100% of the thickness of the blade.

11. The creping blade of claim 1 wherein the trailing edge has a length of greater than or equal to about 0.002 inches (about 0.051 mm) and the trailing edge radius is between about 0.002 inches (0.051 mm) and about 0.05 inches (1.27 mm).

12. A creping blade comprising:

a body having a thickness, a leading side, a trailing side, and working end including a bevel surface;

the bevel surface is planar and is defined by a leading edge and a trailing edge; the bevel surface has a length and the trailing edge has a length;

wherein the length of the trailing edge is no more that about ½ the length of the bevel surface and wherein the trailing edge is convex and has a trailing edge radius of greater than about 0.002 inches (about 0.051 mm);

and wherein the trailing edge has a length that is less than about ¾of the length L of the bevel surface.

13. The creping blade of claim 12 wherein the trailing edge radius is at least about 0.003 inches (about 0.076 mm).

14. The creping blade of claim 12 wherein the trailing edge includes a substantially uniformly shaped arc, wherein the arc has a centerpoint and a radius and wherein the centerpoint from which the radius extends is about equidistant from the bevel surface and the trailing side of the blade.

15. The creping blade of claim 12 wherein the trailing edge includes a non-uniformly shaped curve.

* * * * *